United States Patent [19]

Simmons

[11] 4,446,794

[45] May 8, 1984

[54] PRACTICE SHELL PARTICULARLY USEFUL FOR TRAINING PURPOSES

[75] Inventor: Björn Simmons, Karlskoga, Sweden

[73] Assignee: Aktiebolaget Bofors, Bofors, Sweden

[21] Appl. No.: 415,048

[22] Filed: Sep. 7, 1982

Related U.S. Application Data

[63] Continuation of Ser. No. 134,233, Mar. 26, 1980, abandoned.

[30] Foreign Application Priority Data

Apr. 2, 1979 [SE] Sweden ..... 7902890

[51] Int. Cl.[3] ..... F42B 9/20

[52] U.S. Cl. ..... 102/513; 102/334; 102/444; 102/498; 102/529; 102/473

[58] Field of Search ..... 102/334, 364, 365, 367, 102/370, 473, 498, 501, 502, 513, 517

[56] References Cited

U.S. PATENT DOCUMENTS

| | | | |
|---|---|---|---|
| 2,872,865 | 2/1959 | Skaar | 102/473 |
| 3,053,185 | 9/1962 | Oberfell et al. | 102/532 |
| 3,103,887 | 9/1963 | Nepple | 102/473 |
| 3,181,465 | 5/1965 | Anthony . | |
| 3,308,759 | 3/1967 | Sorenson | 102/505 |
| 3,848,532 | 11/1974 | Abbott | 102/367 |
| 3,911,824 | 10/1975 | Barr et al. | 102/513 |
| 4,109,579 | 8/1978 | Carter | 102/529 |
| 4,218,976 | 8/1980 | Luebbers | 102/473 |
| 4,227,460 | 10/1980 | Krone | 102/529 |

FOREIGN PATENT DOCUMENTS

| | | |
|---|---|---|
| 523900 | 7/1940 | United Kingdom . |
| 804899 | 11/1958 | United Kingdom . |
| 903484 | 8/1962 | United Kingdom . |
| 904287 | 8/1962 | United Kingdom . |
| 1123892 | 8/1968 | United Kingdom . |
| 1228204 | 4/1971 | United Kingdom . |
| 1293416 | 10/1972 | United Kingdom . |
| 1302872 | 1/1973 | United Kingdom . |
| 1339516 | 12/1973 | United Kingdom . |
| 1463347 | 2/1977 | United Kingdom . |
| 1465760 | 3/1977 | United Kingdom . |

*Primary Examiner*—Harold J. Tudor

*Attorney, Agent, or Firm*—Pollock, Vande Sande & Priddy

[57] ABSTRACT

A full-caliber shell for training purposes to be fired with a low charge in a large-caliber firearm, e.g. a howitzer or a gun. THe shell comprises a front part (1) made of heavy material and an effect part casing (2) and a bottom unit (3) substantially made of plastic material which is highly resistant to high pressures. The effect part casing comprising the effect part and the bottom unit is arranged to withstand the great stress forces which arise in connection with the firing of the shell in the howitzer when the heavy front part is to be accelerated by means of said effect part and bottom unit. The stress forces are then very pronounced, and are of the magnitude of those arising in connection with the firing of a steel shell with the corresponding charge. The heavy front part (1), the effect part with its charge, and the bottom part are carefully balanced in relation to each other so that they give ballistics and a weight which makes the new shell substantially equal to the steel shell which the new shell is to supersede. In addition to the effect part casing the effect part comprises a tubular unit arranged coaxially in the effect part casing. The effect part casing and the tubular unit are connected with spoke-formed elements which extend in the longitudinal direction of the effect part. The shell can be made at a very low cost, has a small risk upon impact, and gives a good indication effect and great safety.

12 Claims, 6 Drawing Figures

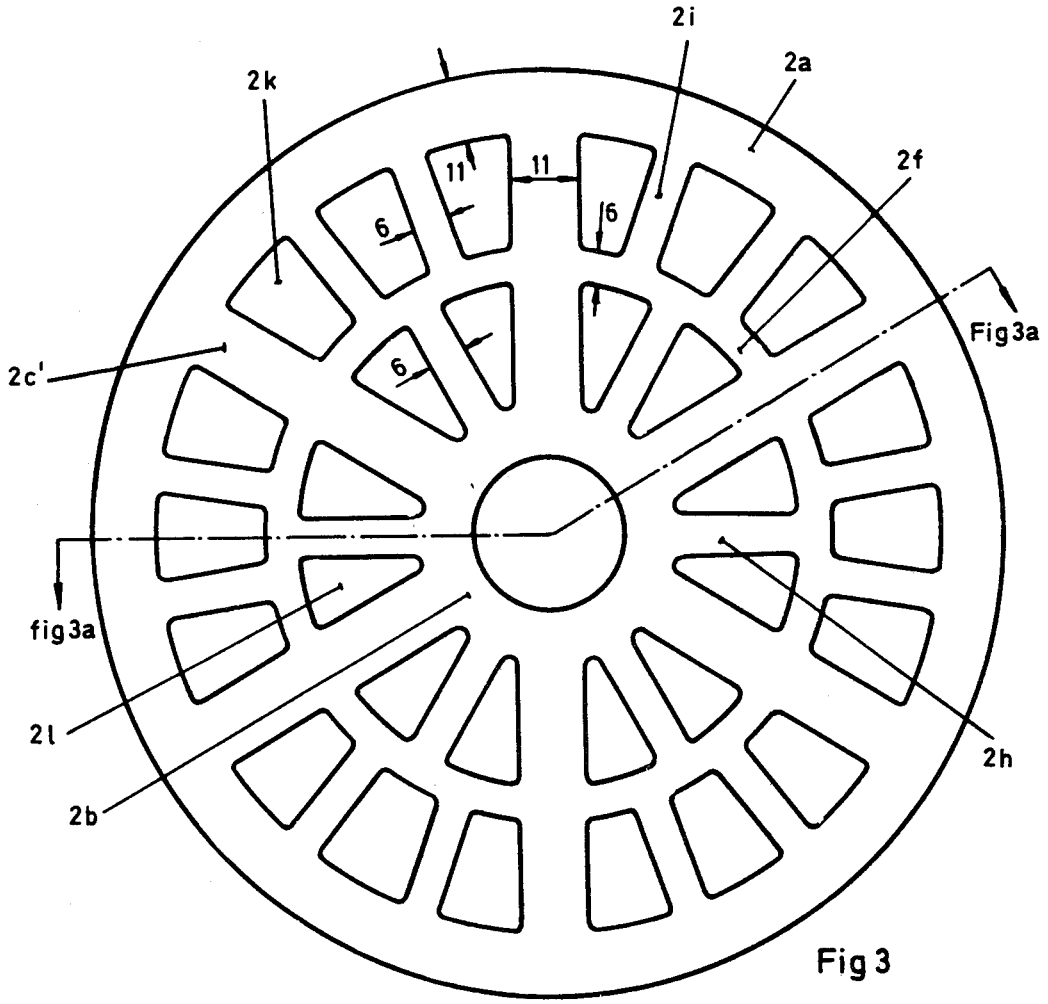
Fig 3
Fig 3a
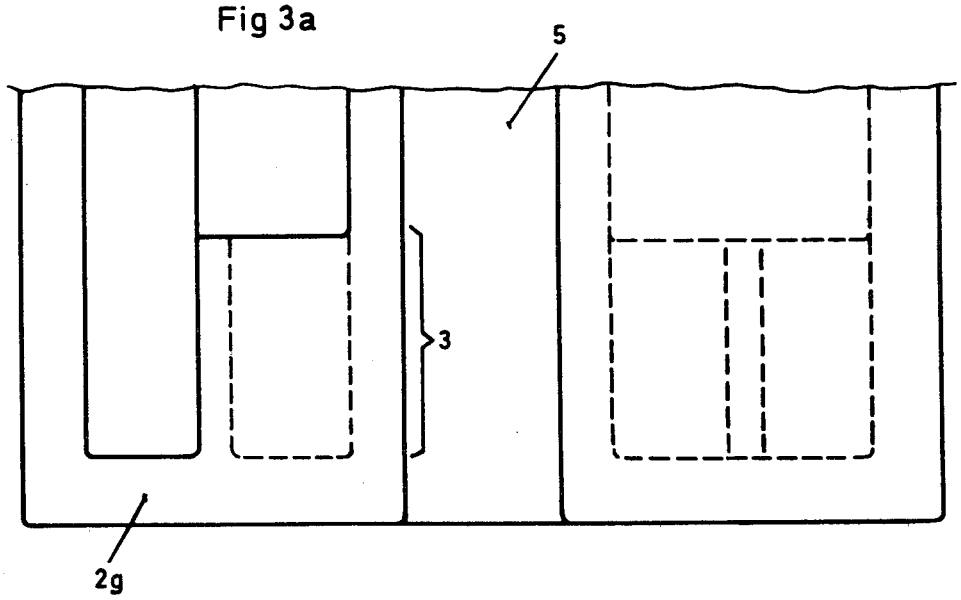

PRACTICE SHELL PARTICULARLY USEFUL FOR TRAINING PURPOSES

This is a continuation Ser. No. 134,233 filed Mar. 26, 1980, now abandoned.

TECHNICAL FIELD

The present invention relates to a full-caliber practice shell particularly useful for training purposes, which is intended to be fired in a large-caliber firearm, such as a howitzer or gun permitting firing with a reduced propellant charge. A large-caliber firearm as used herein means a weapon caliber of 75 mm and more.

BACKGROUND ART

In connection with weapon training, there is a general endeavour that the weapon crews should be given opportunities for natural training in ammunition handling in connection with the firing of the type of weapon in question. Primarily because of the high costs involved in firing of live ammunition, for training and practice purposes it is desirable to use practice ammunition to the greatest possible extent.

A great many shells for training purposes are previously known. Thus, it has been proposed, for instance, to utilize a practice shell with a bursting body made of steel and containing an indication composition and a reduced bursting charge. It has previously also been proposed to utilize non full-caliber practice ammunition in connection with so-called subcaliber weapons or subcaliber barrels.

DISCLOSURE OF INVENTION

With non full-caliber ammunition used with said subcaliber weapons, the natural training sought for the ammunition functions for said firearm are not achieved. The hitherto known full-caliber ammunition is comparatively expensive, and it is very strongly desired to reduce the costs considerably.

Further, the known training ammunition requires extensive safety measures, owing to the great fragmentation risk zone in connection with the firing. The indication effect at the point of impact of said shell can be insufficient in certain cases, which complicates effective measurements at the point of burst. The known training ammunition is also fired with comparatively large propellant charges, which also constitutes a drawback from the point of view of costs.

In accordance with what is stated above, the requirement for a practice projectile which gives natural training of all ammunition functions for the type of weapon in question, and a small risk zone for fragmentation, combined with the desired lowest possible price has not been realized.

The present invention proposes a projectile or shell which provides the solution of one or more of the problems mentioned.

In accordance with the present invention it is proposed that the full-caliber shell should be made with a front part made of heavy material and an effect part and a bottom part made substantially of plastic material which is resistant to high pressures. As examples of plastic materials in this connection are injection mouldable plastics such as polyacetal, polycarbonate, or the like, with a high glass fiber content. Also compression moulded glass-filled polyester and others can be used. In accordance with the invention, the effect part and the bottom part are moreover arranged to withstand stresses of a magnitude substantially corresponding to those arising on a conventional shell made of steel when this is fired in the firearm with a corresponding charge, and also together with the front part and a charge contained in the effect part to ensure a weight and ballistics which substantially correspond to the weight and ballistics of a shell made of steel. It is then characteristic for the effect part, in addition to the effect part casing, comprises a tubular unit arranged coaxially with the casing and the effect part casing and the tubular unit are conrected to each other via radially extending spoke-formed elements or wings, which are straight or curved.

In connection with further aspects of the invention, a more detailed design of the shell is proposed for achieving effective dispersion of an indication substance being carried. As the effect part is made of plastic material, it is also proposed that the driving band should be made directly in the plastic material of the effect part eliminating the use of a separate driving band which, in itself, is comparatively expensive, and which is otherwise normally an additional part of the shell.

Further developments comprise detailed structure for the embodiment of the shell or projectile and the positioning and location of a fuse utilized in the shell or projectile, which is primarily a comparatively cheap electric base fuse, although it is also possible to utilize a more expensive fuse located in the nose.

The features that can mainly be considered to be characteristic of a formed according to the present invention will be noted from the following description, drawings, and claims.

ADVANTAGES

The use of the combination of a heavy front part, made for instance of conventional commercial steel or cast grey iron, and an effect part and a bottom unit of plastic material, produces a shell which is very favourable from an economic point of view and which is suitable for use in connection with the basic training of weapon crews.

Such a projectile does indeed obtain a low axial moment of inertia, which can appear to lack effective stability. The shell is intended to travel at subsonic velocity ($M<1$) when firing with charge 1, which gives an MV of approx. 300 m/s. If the firing takes place with charge 2, which gives $M=1.09$ or $MV=370$ m/s, the shell still travels with subsonic velocity in the major portion of the trajectory. In accordance with the invention, the bottom unit is made of plastic material of said kind notwithstanding the low axial moment of inertia, a comparatively short distance exists between the centre of gravity of the shell and its centre of pressure, which together with a comparatively small transversal moment of inertia of the shell gives the stability sought.

The ballistic properties and weight of the projectile can then be made so that they substantially correspond to the ballistic properties and weight of the live ammunition, which provides for said natural training with the ammunition functions.

Upon impact, the effect part bursts, and the bottom unit and the plastic material in question produce light fragments with greater air resistance, and are not expected to travel longer than $\leqq 25\%$ compared with the steel fragments from a normal practice shell.

In further developments of the invention, effective dispersion of an indication substance utilized is obtained, which upon impact of the shell is dispersed to form a cloud, and thereby gives a good indication of the impact, for instance in the form of black smoke.

The filling of the indication substance into the shell can be done in straight prismatically formed spaces in the effect part, and not, for instance, through casting via a small hole in the point of the shell.

The electric fuse used with further embodiments, which is located at the rear of the shell, also makes the training shell cheaper in comparison with the case of a fuse cavity made with high precision in the point of the projectile, and a comparatively expensive nose fuse. However, nose fuses can be utilized in the training shell if desired.

With the aforesaid embodiments of the invention it becomes possible to fire a shell with a propellant charge which for 155 mm ammunition gives a range of approx. 7 km, a muzzle velocity of approx. 300 m/s and a maximum pressure of 40–70 MPa. As an example, it can be stated that the practice shell in question is primarily intended to travel in the ballistic trajectory with subsonic velocity, for instance with M=0.80.

To summarize, it can be stated that the present invention is intended to provide for a practice shell for training purposes which:

(1) gives normal gun function and handling,
(2) at the point of impact gives a small risk zone, which is 25–50% of that of a conventional practice shell,
(3) is particularly inexpensive and can be made for 50% or less (possibly for as little as 30%) of the costs of the practice ammunition utilized at present,
(4) gives a good indication effect for measuring the bursting point of a heavy steel casing being eliminated,
(5) through the shortening of the range (e.g. 7–9 km) requires only a low charge (charge 1 or 2) which involves cost savings,
(6) gives comparatively good safety in the event of a burst in the bore, since it makes it possible to use a small quantity of explosive, which is dampened by the indication substance. The greatest damage to the barrel in case of a burst would be a minor deformation in the inside of the barrel,
(7) makes it possible to eliminate the costs of a separate, comparatively expensive copper driving band, which on the new training shell can be replaced by a cheap plastic driving band made directly on the outside of the effect part when this is manufactured, and
(8) makes it possible to have the same weight and ballistic properties as the conventional ammunition.

BRIEF DESCRIPTION OF DRAWINGS

An embodiment proposed for a training shell which has the characteristics of the invention will be described in more detail with reference to the accompanying drawings, in which:

FIG. 3 in a second cross section, show the bottom configuration of the effect part of the shell, FIG. 3*a* in a longitudinal section taken in FIG. 3 shows the bottom configuration of the effect part 5, FIG. 4 in a longitudinal section shows an enlargement in relation to FIG. 1 and in full scale parts of the shell according to FIG. 1 and the corresponding parts of a conventional, previously known steel shell which the new shell is intended to correspond to, and FIG. 5 in a longitudinal section of a modified embodiment of the parts according to FIG. 4.

BEST MODE OF CARRYING OUT THE INVENTION

The figures refer to an embodiment of a 155 mm practice shell, which, for instance, in a howitzer is intended to be fired with a low charge, i.e. charge 1 and possibly charge 2. The muzzle velocity MV will then be approx. 300 m/s and 370 m/s, respectively, and the pressure in the barrel will have a value of approx. 40 MPa and 70 MPa, respectively (4–7 kp/mm$^2$). The acceleration stresses will be approx. 2000 g and 3500 g, respectively, and the shell shall thereby be able to absorb a total pushing force in the barrel of approx. 75 and 130 tons, respectively. Depending upon the appearance of the rear end, the maximum range with charge 1 will be between approx. 6700 m (with a cylindrical rear end) and approx. 7400 m (with a tapered rear end). The practice shell in question is intended as a subsonic shell, and has a mean velocity in the ballistic trajectory of 0.8 M. Depending on the twist of the rifling in the firearm, the rotating speed of the shell will be between 5000–6000 r/m and 7000–8000 r/m, respectively.

Figure 1:
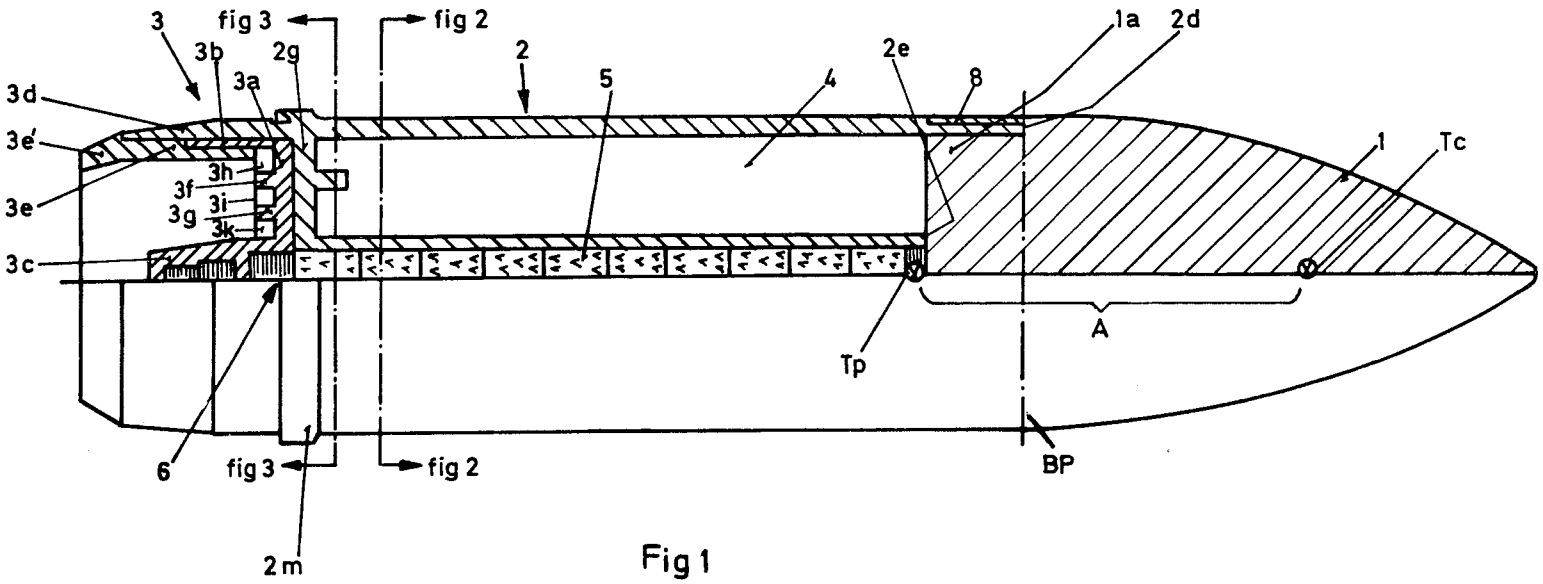
FIG. 1 in a partly longitudinal section shows the new shell.

In principle, the training shell according to FIG. 1 is composed of three parts, viz. a front part 1, an effect part 2 and a bottom unit 3, and the shell moreover does not have a separate, expensive copper driving band, but instead has the driving band made of the same material as the effect part. The front part is heavy and is made of a cheap, conventional steel material, or consists of die-cast iron.

In spite of said severe environmental conditions for the shell in the barrel and at the gun muzzle, the effect part casing and the bottom unit are made mainly of plastic material, in accordance with the concept of the invention. An example of the plastic material is here glass fiber reinforced polyacetal, containing approx. 50% glass fiber. Further, glass fiber reinforced polycarbonate with approximately the same content of glass fiber can be used. A further material which can be used in this connection is polyethylene erephthalate. Commpression moulded polyester with 40% glass fiber can also be used. The compression strength of said plastic material is between 135 and 195 MPa and the coefficient of elasticity is between 9000 and 1500 MPa.

Said plastic material has great resistance to the high pressures and stresses that arise when the bottom unit and the effect part are to accelerate the heavy front part in the bore of the barrel. The configurations then chosen of the bottom unit and the effect part casing are essential in order that the most uniform distribution of stresses possible shall be obtained along the entire plastic material, so that no sections of it will be overloaded. In one embodiment, the effect part casing can also be dimensioned on the basis of the fact that an indication substance shall be well compacted and possibly plastic bonded so that it can relieve the effect part casing to a certain extent.

The effect part casing shall then also be designed to hold a carried load of sufficient size, in the present case an above-mentioned indication substance 4 which is dispersible with an explosive charge 5, and it is then essential that the substance 4 and the explosive charge 5 can be arranged so that effective dispersion of the indication charge is obtained when the bursting charge is initiated. For safety reasons, the size of the bursting charge is chosen so that barrel rupture will be avoided in case of a burst in the bore, and said plastic material in the effect part then gives substantial advantages compared with a steel material.

It is also essential that the new practice shell have ballistics and a weight which substantially conform to the corresponding parameters for the practice shell made of steel which the new training shell is intended to supersede.

The ballistic properties of the new shell correspond to the ballistic properties of the conventional live or practice shell, although in relation to said conventional shell it has a low axial moment of inertia, which involves difficulties in obtaining sufficient stability in the trajectory. In the object of the invention, this problem has been solved in that, notwithstanding the difficulties involved, it has been possible to balance the parameters of which the stability is dependent against each other. It has then proved to be essential to have distance A between the centre of pressure TC of the shell and the centre of gravity TP chosen to be very little, and it is only between 25–30% of the total length of the shell, which is favourable for the stability factor as said distance A comes in as the square of same. The total length of the shell is, for instance, approx. 720 mm.

The moving forwards of the centre of gravity TP is possible because the point is heavy and the bottom unit and the effect part are comparatively light. They must also be specially designed in order to be able to withstand the environment in the barrel and at the gun muzzle.

In order to obtain a weight which substantially corresponds to the "natural" ammunition weight, the front part is comparatively heavy, and can be chosen to be approx. 28 kg in the present embodiment. The front part has a length of approx. 40–45% of the total length of the projectile. In the embodiment, the front part has an ogival form and at the rear, has a neck 1*a*, which via the effect part is secured to the front part. Said securing can be carried out by means of a pressure ring made of steel, shown in FIG. 1 and indicated in the following, or by a connection of another kind which is known in itself, for instance threads, rivets, etc.

Along the major portion of its longitudinal extent, the effect part has a cross section configuration according to FIG. 1. In principle, the effect part is built up of two coaxially arranged tubes 2*a* and 2*b*, which are connected to each other by means of wings 2*c* or spokes extending radially in the longitudinal direction of the effect part. In the present case, the inner tube has an inner diameter of approx. 27 mm and the outer tube has an inner diameter of approx. 137 mm. There are six wings or spokes. In the present case, the averge thickness of the outer tube, the inner tube and the spokes is 10 mm. The supporting section area will be approx. 8400 $mm^2$, and the free surface between the spokes approx. 1055 $mm^2$. Said wings or spokes are preferably straight, but can also be curved in the radial and/or axial direction.

The inner space in the inner tube is utilized as a first space for a bursting charge (TNT) and/or a flash bursting charge. The six prismatic, elongate spaces between the tubes and the spokes serve as second spaces for the indication substance, which can be of a kind which is known in, and which gives good indication, for instance black smoke and/or flash, during impact of the shell. Through the configuration of the straight, prismatic spaces in the example of the embodiment, the filling of the indication substance will be comparatively easy to carry out at the manufacture.

With the above-mentioned weight of the front part, a total shell weight of approx. 43 kg is obtained. With Pmax 60 MPa a load in the absorbing area of approx. 84 mPa is obtained. With E=10500 MPa an elastic compression=0.8%, i.e. 2.4 mm on a length of 300 mm is obtained. The weight of the comparative shell made of steel is also 43 kg.

Figure 2:
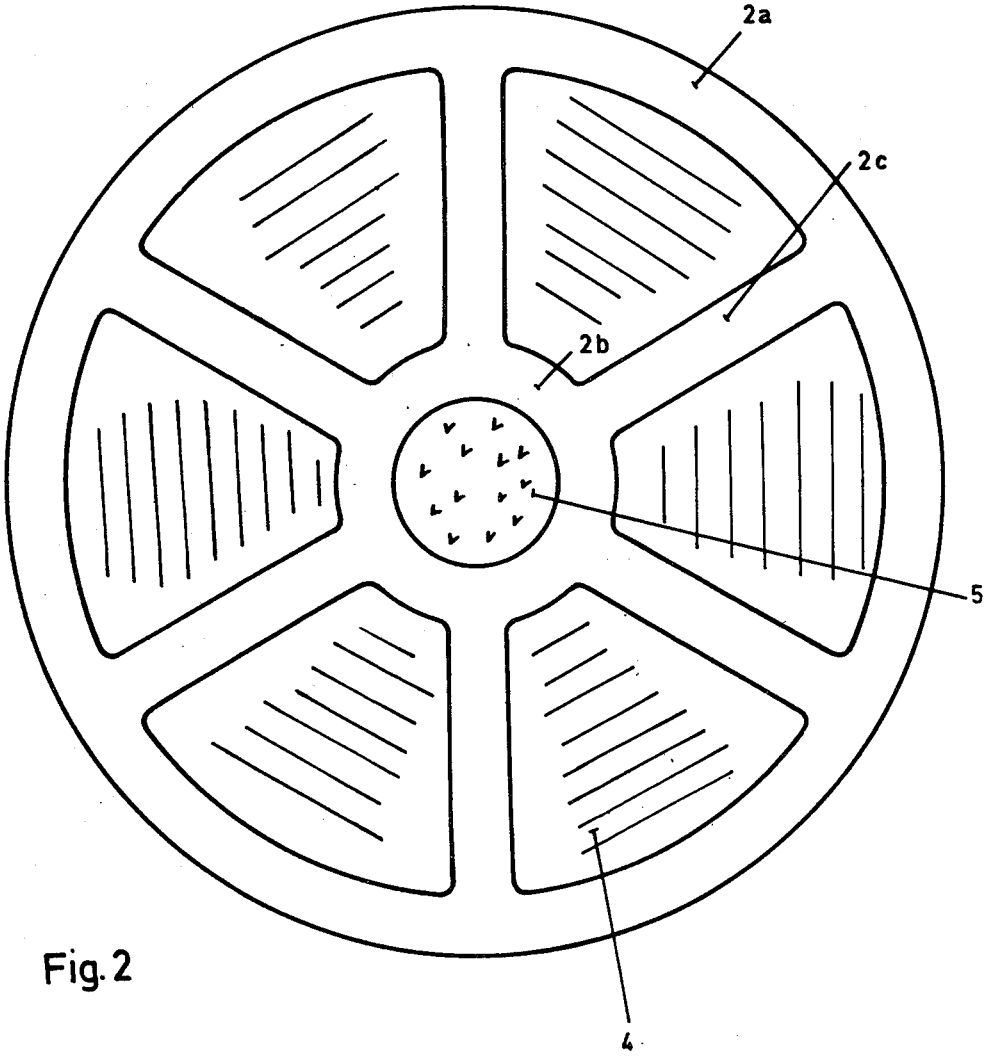
FIG. 2 in a first cross section below the point of the shell.

Said tubes 2*a*, 2*b* coact with the heavy front part via end surfaces 2*d* and 2*e*, respectively. In order to obtain effective stress equalizing in the plastic material of the effect part, the effect part 1 has been made with a stress absorbing section according to FIG. 2 at its parts facing the bottom unit. In this case, an intermediate ring 2*f* has been used. At this end, the effect part is made with an 11 mm thick bottom part 2*g*, and the intermediate ring extends approx. 35 mm over this bottom part in the forwards direction of the effect part, Cf. the distance B in FIG. 3*a*. The intermediate ring is connected with the inner and outer tubes via said spokes 2*c*′ which have a thickness of approx. 11 mm. Further, the intermediate ring is connected with the inner tube 2*b* via first radially extending connecting elements 2*h*, of which there are six, and which have a thickness of approx. 6 mm. The intermediate ring is also connected with the outer tube via extra, radially extending connecting elements 2*i*, of which there are twelve, which are 6 mm thick. The wall of the outer tube has a thickness of 11 mm. The small prismatic spaces formed between said intermediate ring and the radially extending connecting elements, and the spokes 2*c*′ and the tubes 2*a* and 2*b* are also filled with indication substance. The indication substance is compacted, so that it will be able to absorb part of the load on the effect part casing. Even if the effect part casing in itself can be expected to absorb the entire load, this gives a good safety margin.

The bottom unit is made with a tapered "skirt", directed rearwards, which gives reduced base drag, and which fulfills the great stress requirements in conjunction with the exit ballistics, and is sufficiently light to make it possible to have the centre of gravity of the shell placed far to the front as shown in FIG. 1.

The bottom unit is provided with a bottom plate 3*a* in contact with the bottom part 2*g* of the effect part, which is made with an outer edge 3*b* directed rearwards and a centre part 3*c* extending parallel to the outer edge, and which extends somewhat past the outer part. The bottom part also comprises a flange 3*d* on the effect part, which is directed rearwards. The outer edge is secured to said flange 3*d* via securing means not specially shown, which can comprise glue threads, compression rifling, welded joints, etc. In a first embodiment according to FIG. 4, a rear reinforcing sleeve 3*e* which is included in the bottom unit can be secured to the outer edge 3*b* and the flange 3*d*. The securing of the reinforcing sleeve to the outer edge and the flange is also done by means of glue threads, compression rifling, welded joints, etc. The reinforcing sleeve constitutes the rear end of the shell, with a tapered rear section 3*e*′, which extends behind said flange 3*d*.

The bottom plate 3*a* with its outer edge 3*b* and centre part 3*c* has reinforcing rings 3*f* and 3*g* which are connected with radially extending reinforcing elements 3*h*, 3*i* and 3*k* between the outer edge, the reinforcing rings 3*f*, 3*g*, and the centre part, respectively. This latter reinforcing arrangement or lattice work is made in a similar way as described above for the bottom part of the effect part, and is calculated to give an equalized distribution of stresses in the material which is optimized in relation to the weight of the material. The sleeve 3*e* can have an inner diameter of approx. 120 mm.

Figure 4:
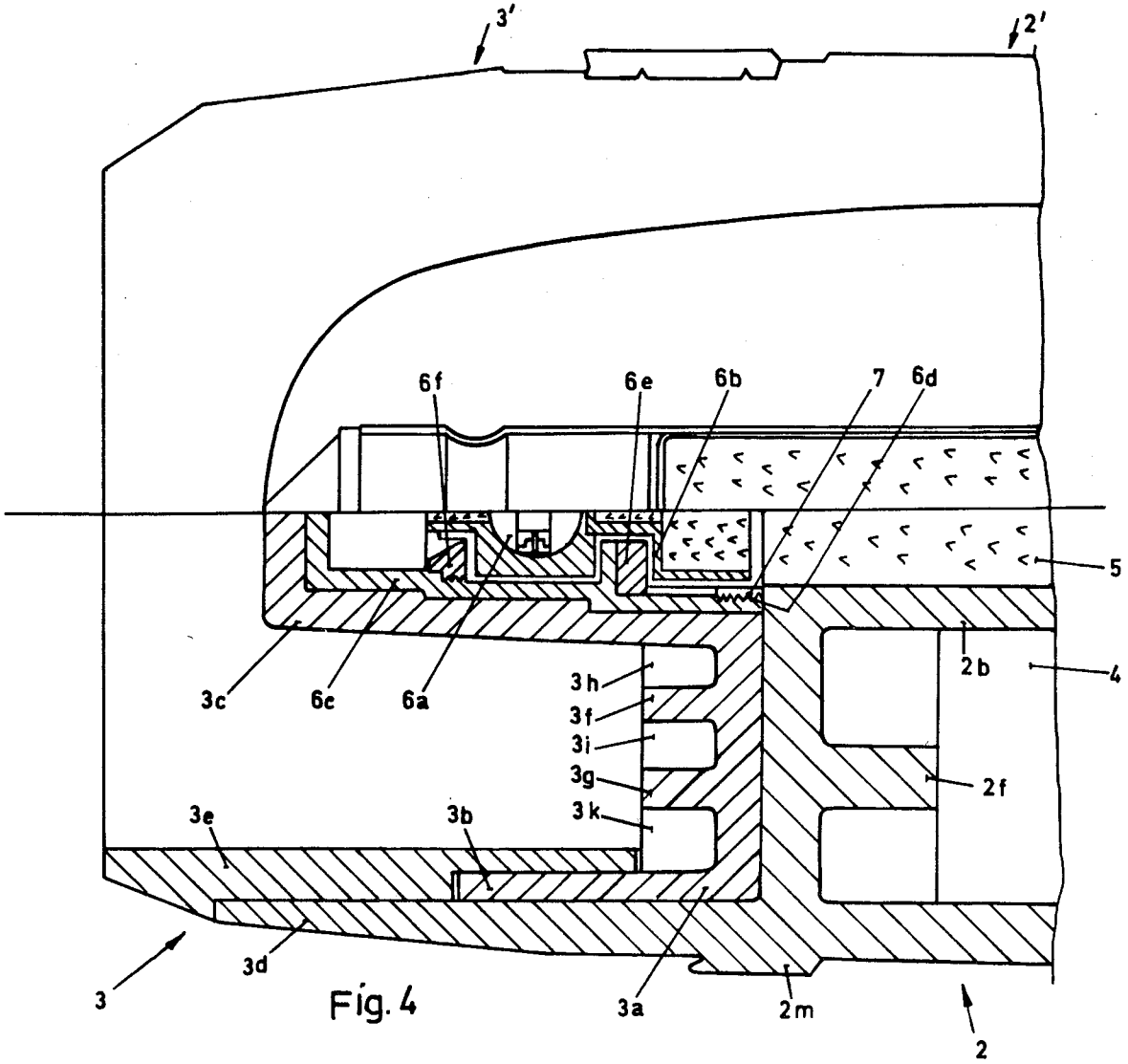
Figure 5:
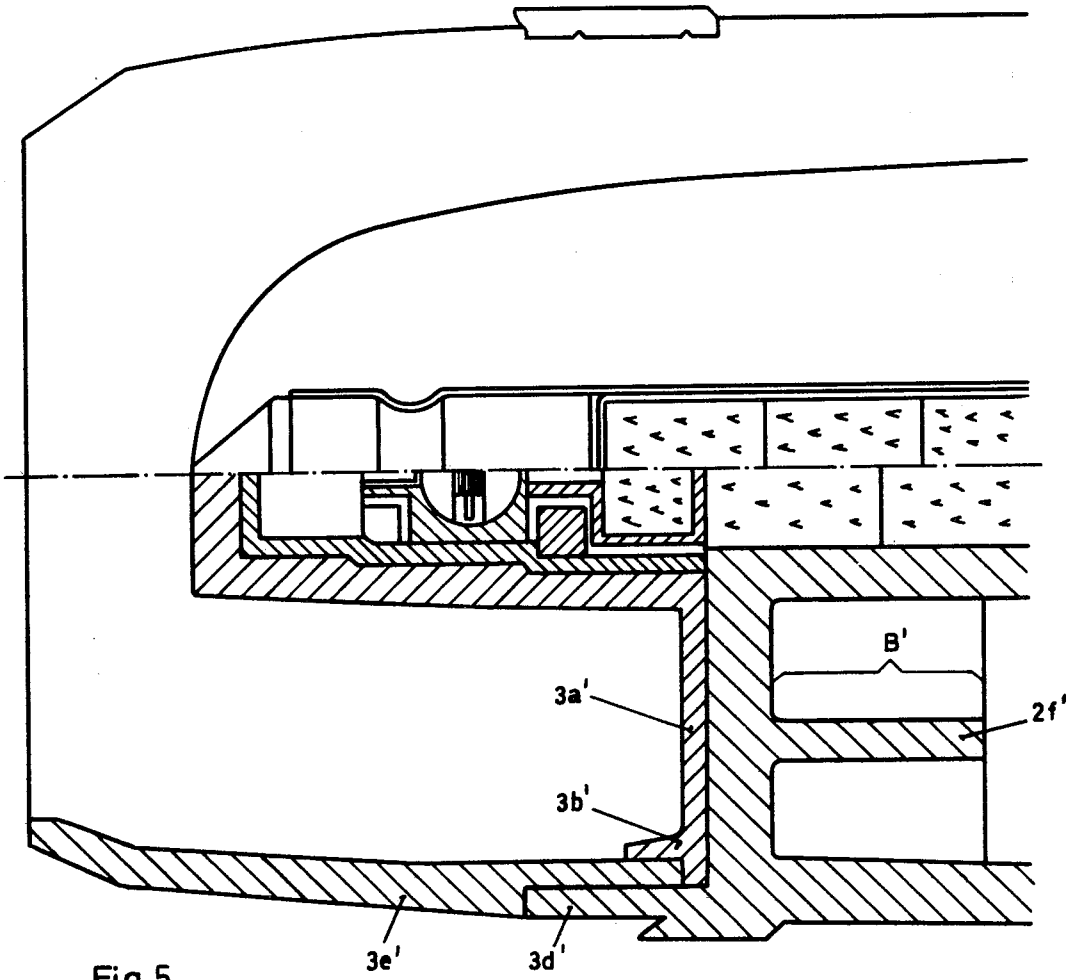

An alternative embodiment of the configuration of the bottom of the shell is shown in FIG. 5. In this case, the bottom plate 3*a'* does not have the reinforcing elements 3*h*-3*k* as in the embodiment shown in FIG. 4. The flange 3*d'* directed rearwards of the effect part casing is shortened, as is also the outer edge 3*b'* which is directed rearwards. In this case, the sleeve 3*c'* alone forms the rear parts of the shell, and at its front part is inserted between the edge 3*b'* and the flange 3*d'*. The embodiment according to FIG. 5 is intended for firing forces of approx. 40 MPa, i.e. charge 1. When firing with charge 2, i.e. approx. 70 MPa said embodiment can be complemented with reinforcements in accordance with the embodiment shown in FIG. 4. As regards the design of the configuration of the bottom of the effect part according to FIG. 5, the distance B' has been extended and the thickness of the intermediate ring 2*f'* has been made less, B'=35 mm and said thickness=6 mm.

The various parts of the bottom unit are made of the abovementioned light plastic material, and can possibly comprise an encapsulated reinforcement made of light metal, steel, carbon fiber, or the like.

At the bottom unit and at said flange 3*d* directed rearwards the effect part is connected with a driving band 2*m* of plastic material. As the driving band can be made directly of the material of the effect part casing, great advantages are gained, among other things from the point of view of costs, since an expensive, separated copper driving band is eliminated. The driving band 2*m* is made (cast or formed) in the same tool as the effect part.

The steel band which exerts a pressure on the outer plastic tube 2*a* around the neck 1*a* on the point is designated with the numeral 8. The pressure band has a width which substantially corresponds to the length of the neck 1*a*.

The outer plastic tube is cut down at the place where it coacts with the pressure band in order to form a smooth outer surface on the shell. The pressure ring absorbs the breaking stresses which arise in the neck 1*a* owing to the centre of gravity of the point being in front of the neck 1*a* and the centre of gravity of the shell being behind the neck.

The centre part 3*c* is arranged to enclose a fuze 6 which, in order to keep the total projectile cost low, consists of a cheap electric fuze arranged in said rear parts.

Said electric fuze can be of the kind which utilizes magnetic breaking during the acceleration in the barrel and voltage storage in a capacitor. Said fuze also utilizes inertia contact for the impact function, with the ordinary safety devices which, inter alia, gives required safety distance from the gun muzzle.

In FIG. 4, an exploder is designated 6*b*. The exploder 6*b* is placed between the TNT core 5 and an electric generator 6*a*. Said ignition system is placed inside an inner casing 6*c* which is secured via threads 6*d* in a central fastening pin 7 belonging to the effect part, which extends around the inner space of the tube 2*b* for the TNT core. The fastening pin 7 has threads which correspond to the thread 6*d*, and is made with a through hole, via which the exploder is connected with one end of the TNT core.

The generator part 6*a* and the exploder 6*b* are placed inside the inner casing and are secured to each other in the longitudinal direction by means of the guide members 6*e* and 6*f* in a way which is known in the art. The inner casing with electric generator and the exploder inserted can be screwed to the effect part via said threads 6*d*.

Through the centrally located bursting charge and the indication substance arranged outside of this, effective dispersion of the indication substance is obtained, which in this way can give a clear indication, for instance in the form of black smoke, of the point of impact of the shell. As the bursting charge can consist of a flash charge, the impact can also be indicated by a flash. The safety zone around the point of impact of the shell will be small, since the plastic material gives light fragments subject to great air resistance. The heavy front part is not affected, but enters the ground. In accordance with the above, the new shell has full caliber, and substantially the same weight and length as the main ammunition.

The shell can also be used for other purposes, for instance it can be utilized for spreading reflecting material for radar jamming and the like.

A detailed example of inter alia the gyrostability value Sg which can be obtained with a shell according to the invention is as follows. An example is then given for a 155 mm practice shell with a cast iron point ($\phi$=7.2) and plastic casing and bottom unit in accordance with what is described above. The practice shell is assumed to have a length of 716 mm, and the ogival point then has a length of 260 mm and the length of the neck 1*a* is approx. 60 mm. The outer plastic tube has a length of 330 mm, and the inner plastic tube has a length of 270 mm (330–60 mm).

The solid bottom plate with the external driving band between said tubes and the final "skirt" on the shell has a thickness of 21 mm, while the length of said "skirt" is 105 mm. The steel pressure band 8 has a width of approx. 60 mm ($\phi$=7.8). The indication mass has $\phi$=2, which with the correction for the spokes between the plastic tubes gives $\phi$=1.88. The bursting charge has $\phi$=1.7 and the plastic material has $\phi$=1.8.

With a design which, for the rest, substantially corresponds to the shell described above, a total mass $P_{tot}$ of 38.32 kg is obtained. The position of the centre of gravity TP is related to a rear surface BP (FIG. 1) on a part in the form of a truncated cone on the ogival point which ideally can be divided in the longitudinal direction into a front cone, said truncated cone, and behind the latter a cylindrical part.

In the example given with $P_{tot}$ of 38.32 kg, TP will be located 46 mm behind the rear surface BP counted from the point. The centre of pressure TC for the design in question of the shell will be located 155 mm in front of said rear plane, and the distance A between TP and TC will thus be 20.1 mm or 1.3 calibers.

The transversal moment of inertia of the respective shell elements around the own centres of gravity of the elements are here designated $I_x$, while $I_x$TP× the transversal moment of inertia of the element around the centre of gravity TP of the shell. In the shell design described above, a total $I_x$TP for the shell itself of 9035 kpcm$^2$ is obtained.

Further, the total axial moment of inertia Iy can be calculated at 990 kpcm$^2$.

$$\text{The gyrostability value } Sg = \frac{Iy^2 \times (\text{rotation in rad/s})^2}{I_{xTP} \times 4 \times M},$$

and then $M=(\pi/8)=\rho_{air}\times$shell diameter$^3\times MV^2\times(TP-TC)\times 2$ The rotation is dependent on the twist of rifling used in the shell, which in the present case can be chosen to be 20 cal/turn, which at MV=300 m/s gives $$\text{Rotation} = \frac{300}{20 \times 0.155} = 96 \text{ turns/s} = 608 \text{ rad/s}$$

With values inserted, $M=\pi/8\times 1.3\times 0.155^3\times 300^2\times 1.3\times 2=444.9$ $$Sg = \frac{0.099^2 \times 608^2}{0.9035 \times 4 \times 444.9} = 2.25 \text{ (no dimensions) } (Sg \text{ 1 but 3 for stability})$$

Said value of 2.25 for Sg will be better than necessary, as values of 1.4-1.6 are entirely acceptable to give the trajectory ballistics required when the shell at the point of impact hits the ground nose first.

The invention is not limited to the embodiment shown as an example, but can be subject to modifications within the scope of the following claims and the concept of the invention. The essential point is that the shell can be made at a low cost (30–50% of the cost of present practice ammunition), that the risk zone at the point of impact will be small (25–50% of that of the ammunition used at present), that a good indication effect is obtained, and/or that the shell is bore safe.

The new shell is easy to manufacture with efficient manufacturing procedures, which gives extremely low production costs. The new shell is also easy to integrate in the basic training which at present takes place within the unit. In its use in field service, the new shell is a well functioning practice shell, which permits natural training of all ammunition functions in connection with firing where it substantially reduces the safety risks, through a small fragmentation zone, and limits the damage to the barrel used to a minimum in the event of a burst in the bore. Owing to its design, the new shell is also easy to store and maintain under field service conditions.

I claim:

1. A practice shell for simulating a conventional shell for a large caliber firearm comprising:

a bottom unit and effect part made of plastic material resistant to high pressure;

said effect part having a casing coaxial with a tubular unit, said tubular unit and casing connected together by radially extending spoke elements forming an integral one piece structure, said spoke elements formed as wings extending along a major portion of the length of the tubular unit, said casing enclosing an indicator substance and an explosive charge, said effect part and bottom unit connected together at thick end walls which include reinforcing patterns in addition to said spoke elements to form an assembly to withstand stress forces which result from discharging said firearm; and a front part connected to a remaining end of said effect part, said front part made from a material heavier than the material from which said bottom unit and effect part are made, whereby said front part, effect part, and bottom unit comprise a shell having a weight and ballistics substantially equivalent to said conventional shell.

2. A practice shell according to claim 1, wherein the effect part casing forming an outer tube, and the tubular unit an inner tube having a first space, second spaces located between the outer and inner tubes, said wings and said second spaces providing prismatic forms.

3. A practice shell according to claim 2, wherein the end of the effect part facing the bottom unit includes a short intermediate ring extending in the longitudinal direction of the effect part placed between said coaxially arranged outer and inner tubes, and the intermediate ring is connected with said tubes via said wings, and radially extending first and second connection elements between the inner tube and the intermediate ring and between the intermediate ring and the outer tube, respectively, whereby a substantially equal distribution of stresses in the material of the effect part is obtained absorbing said stress forces.

4. The practice shell of claim 1, wherein said bottom unit and effect part casing are made of a high pressure resistant material selected from the group consisting of injection moulded glass fiber reinforced with polyacetal, glass fiber reinforced polycarbonate, polyethylene erephthalate, and polyester thermosetting plastic.

5. A practice shell according to claims 2, 3, 1, or 4, wherein the bottom unit comprises a bottom plate, an outer edge extending rearwards from a plate, and a center part extending from said bottom plate substantially parallel to said outer edge.

6. A practice shell according to claims 2, 3, 1 or 2 wherein the front part consists of an inert point made of a solid steel material or a cast solid unit of cast iron, and the front part at an end facing the effect part has a neck over which the effect part extends with a fastening section.

7. A practice shell according to claim 2, wherein the first space contains an explosive charge and an prismatically shaped second spaces contain an indication substance, whereby good dispersion of the indication substance is obtained when the bursting charge is initiated, and the spreading area and risk zone for the plastic material of the effect part will be limited.

8. A practice shell according to claims 1 or 2, further comprising an electric fuse connected with the bottom unit which operates with conventional activation and delayed arming circuits and which is made with a conventional inertia contact controlled by impact.

9. A practice shell according to claim 5, wherein the bottom plate has two reinforcing flanges arranged coaxially with each other, the center part, and outer edge, and which extend rearwards and are connected with each other, the center part and the outer edge via radially extending connecting elements.

10. A practice shell according to claim 5, wherein said outer edge of the bottom unit constitutes a fastening point for a reinforcing sleeve in the bottom unit, the major portion of which is arranged inside said outer edge and a flange extending rearwards from the effect part and with a protruding section forming the rear end of the unit.

11. A practice shell according to claim 2, 3, 1, or 4 further comprising a plastic driving band formed directly in the plastic material of the effect part casing.

12. The practice shell of claim 1, wherein tubular unit, casing and spoke elements provide a plurality of cavities having a prismatic cross section containing said indication substance, and said tubular unit contains said explosive charge.

* * * * *